US006177917B1

(12) United States Patent
Koizumi et al.

(10) Patent No.: US 6,177,917 B1
(45) Date of Patent: Jan. 23, 2001

(54) LIQUID CRYSTAL DISPLAY DEVICE AND METHOD FOR DRIVING THE SAME

(75) Inventors: Takashi Koizumi, Kashihara; Masahiro Imai, Yamatokoriyama, both of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/056,939

(22) Filed: Apr. 8, 1998

(30) Foreign Application Priority Data

Apr. 17, 1997 (JP) ..... 9-100674

(51) Int. Cl.[7] ..... G09G 3/36
(52) U.S. Cl. ..... 345/87; 345/103; 345/94
(58) Field of Search ..... 345/103, 94, 87; 364/518

(56) References Cited

U.S. PATENT DOCUMENTS 5,018,076 * 5/1991 Johary et al. ..... 364/518
5,442,370 * 8/1995 Yamazaki et al. ..... 345/94
5,610,628 3/1997 Yamamoto et al. ..... 345/100
5,668,569 * 9/1997 Greene et al. ..... 345/103

FOREIGN PATENT DOCUMENTS 64-29899 1/1989 (JP) .
7-84554 3/1995 (JP) .
7-199148 8/1995 (JP) .
2506796 B2 4/1996 (JP) .

OTHER PUBLICATIONS

I. Washizuka, "Liquid Crystal Display—Its overview and markets for its applications"; Published by Terumasa Sakai0of Kabushiki Kaisha Radio Gijutsu–sha; Sep. 1, 1991 (with English Translation).

* cited by examiner

*Primary Examiner*—Steven J. Saras
*Assistant Examiner*—William C. Spencer
(74) *Attorney, Agent, or Firm*—Dike, Bronstein, Roberts & Cushman, LLP; David G. Conlin; David A. Tucker

(57) ABSTRACT

A method for driving a liquid crystal display device including a liquid crystal panel which has a pair of substrates facing each other with a liquid crystal layer interposed therebetween and respectively having signal electrodes and scanning electrodes which are located perpendicular to each other, wherein the liquid crystal panel is divided into a plurality of display portions, and the signal electrodes and the scanning electrodes are driven on a display portion by display portion basis, thereby achieving display on the display portions individually, the method comprising the step of detecting and correcting distortion of a signal on each of the signal electrodes or each of the scanning electrodes on a display portion by display portion basis.

8 Claims, 11 Drawing Sheets

LIQUID CRYSTAL DISPLAY DEVICE AND METHOD FOR DRIVING THE SAME

BACKGROUND OF THE INVENTION

1. Field of the Invention

The present invention relates to a liquid crystal display device and a method for driving the same.

2. Description of the Related Art

Methods for driving a liquid crystal display device include a voltage averaging method (see "Ekisyo no Saisin Gijyutu (Latest Technology of Liquid Crystal)" published by Kogyo Chosakai Publishing Co., Ltd., p. 106) and a method for simultaneously selecting and driving a plurality of rows (see T. N. Ruckmongathan, Conf. Record of 1988 International Display Research Conference, p. 80 (1988); T. J. Scheffer and B. Clifton, 1992 SID Digest of Technical Papers XXIII, p. 228 (1992); and S. Ihara et al., 1992 SID Digest of Technical Papers XXIII, p. 232(1992)).

The basic principle of the voltage averaging method and the method for simultaneously selecting and driving a plurality of rows is as follows: A voltage waveform for each scanning electrode corresponding to an orthogonal matrix such as a unit matrix and a Walsh matrix is formed. Moreover, a voltage waveform for each signal electrode is formed by orthogonal transformation of display data based on the orthogonal matrix. Then, the resultant voltage waveforms are respectively applied to each scanning electrode and each signal electrode, and a voltage waveform corresponding to the difference in a voltage waveform between the scanning electrode and the signal electrode is applied to a liquid crystal panel on an intersection by intersection basis of the scanning electrodes and the signal electrodes. Thus, inverse transformation of the display data is performed on the display panel, whereby an image is displayed.

In a liquid crystal display device driven by the above-mentioned methods, a voltage waveform on each signal electrode and on each scanning electrode is distorted by reduction in sharpness or by induction at a changing point in the waveform, causing crosstalk between electrodes.

In the case where a DC voltage is continuously applied to a liquid crystal layer of the liquid crystal panel, liquid crystal will be degraded by decomposition. Accordingly, the liquid crystal panel is driven using an alternating voltage waveform of each signal electrode and each scanning electrode (this driving method is, hereinafter, referred to as an alternating driving method). In the case of the alternating driving method, crosstalk is generated significantly when a polarity of a voltage waveform changes.

Hereinafter, display on a liquid crystal panel as shown in FIG. 5 by the voltage averaging method and the alternating driving method will be described by way of example.

This liquid crystal panel has 10×5 dot display with signal electrodes X1 through X10 and scanning electrodes Y1 through Y5 being located perpendicular to each other. In FIG. 5, a white circle represents a pixel in an ON state, whereas a shaded circle represents a pixel in an OFF state. When the liquid crystal panel has the display as shown in FIG. 5, signals as shown in FIG. 6 are supplied to drive the liquid crystal panel.

In the liquid crystal panel, the scanning electrodes Y1 through Y5 are sequentially scanned during each frame period in synchronization with a horizontal synchronizing signal shown in (a) of FIG. 6. An alternating driving signal shown by (b) of FIG. 6 is inverted at time t1 and t2 of respective frame periods.

Each voltage waveform on the signal electrodes X1 through X10 is inverted in response to the inversion of the alternating driving signal. Referring to FIG. 5, all of the pixels on the signal electrode X4 are ON. Therefore, the voltage waveform on the signal electrode X4 shown by (c) of FIG. 6 indicates ON during a frame period, and is inverted at time t1 when the alternating driving signal is inverted. For the signal electrode X5, only one pixel in a first row is ON, whereas the remaining pixels in second through fifth rows are OFF. Accordingly, the voltage waveform on the signal electrode X5 shown by (d) of FIG. 6 indicates ON corresponding to the pixel in the first row, while indicating OFF corresponding to the pixels in the second through fifth rows. This voltage waveform is inverted at time t1.

Similarly, each voltage waveform on the scanning electrodes Y1 through Y5 is also inverted in response to the inversion of the alternating driving signal. For example, the voltage waveform on the scanning electrode Y1 shown in (e) of FIG. 6 is at a low level at the beginning of the first frame, while attaining a high level at the beginning of the next frame period after time t1.

As a result, a voltage waveform shown in (f) of FIG. 6 is applied to the pixel at the intersection of the signal electrode X4 and the scanning electrode Y1, whereas a voltage waveform shown in (g) of FIG. 6 is applied to the pixel at the intersection of the signal electrode X5 and the scanning electrode Y1.

However, in the case where such crosstalk as mentioned above is present, these voltage waveforms will become as shown in (a) through (g) of FIG. 7.

In this case, a voltage waveform on the scanning electrode Y1 as shown in (e) of FIG. 7 is distorted at time t1 and t2 when the alternating driving signal is inverted. The reason for this will be described in the following in terms of time t1. Before time t1, pixels in the 8 columns of the signal electrodes X1 through X4 and X7 through X10 are ON, whereas pixels in the 2 columns of the signal electrodes X5 and X6 are OFF. In other words, the signal electrodes X1 through X4 and X7 through X10 have a positive potential, whereas the signal electrodes X5 and X6 have a negative potential. Accordingly, positive charges corresponding to 6 dots, the difference in number between the pixels in the ON state and in the OFF state are charged between the scanning electrode Y1 and the signal electrodes. A potential on each of the signal electrodes X1 through X10 is inverted in polarity at time t1. Therefore, these positive charges are discharged through a resistance of the scanning electrode Y1. Thereafter, negative charges corresponding to 6 dots are charged between the scanning electrode Y1 and the signal electrodes through the resistance of the scanning electrode Y1. As a result, the voltage waveform on the scanning electrode Y1 is distorted. Similarly, a voltage waveform on each of the scanning electrodes Y2 through Y5 is also distorted. Since the distortion generation mechanism at time t2 is the same as that at time t1 except for the polarity, description thereof will be omitted.

For example, when the voltage waveform on the scanning electrode Y1 as shown in (e) of FIG. 7 is distorted, a voltage waveform at the pixel at the intersection of the signal electrode X4 and the scanning electrode Y1 as shown in (f) of FIG. 7 is also distorted. Similarly, the voltage waveforms on the other scanning electrodes Y2 through Y5 are also distorted, and the voltage waveforms at the remaining pixels on the signal electrode X4 are also distorted. Therefore, effective voltages applied to the pixels on the signal electrode X4 are reduced, causing reduction in luminance of each pixel on the signal electrode X4.

In addition, a voltage waveform at the pixel at the intersection of the signal electrode X5 and the scanning electrode Y1 as shown in (g) of FIG. 7 is distorted, and an effective voltage applied to the pixel is increased. Similarly, the voltage waveforms at the other pixels on the signal electrode X5 are also distorted, and effective voltages applied to the pixels are increased. As a result, luminance of each pixel on the signal electrode X5 is increased.

Thus, luminance of each pixel on the signal electrode X4 is reduced, whereas luminance of each pixel on the scanning electrode X5 is increased. As a result, vertical stripe lines appear on the display screen.

In order to eliminate such crosstalk, Japanese Laid-Open Publication No. 64-29899 (or see P. Maltese, Eurodisplay Digest, p. 15 (1980)), for example, discloses a method for eliminating distortion of a voltage waveform on each scanning electrode by providing a detection electrode extending in parallel to the scanning electrodes, wherein the detection electrode detects distortion of a voltage waveform induced on each scanning electrode, and applies to every scanning electrode a correction voltage having a polarity opposite to a polarity of the detected distortion so as to eliminate the distortion.

In the case where the above-mentioned method for eliminating crosstalk as disclosed in Japanese Laid-Open Publication No. 64-29899 is applied to the liquid crystal panel shown in FIG. 5, signals for driving the liquid crystal panel are as shown in FIG. 8.

In this case, distortion generated at the detection electrode is detected as distortion of a voltage waveform on any of the scanning electrodes Y1 through Y5. Then, a correction voltage having a polarity opposite to a polarity of the detected distortion is applied to all of the scanning electrodes Y1 through Y5. For example, in the case where distortion generated at the detection electrode is detected as distortion of a voltage waveform on the scanning electrode Y1 as shown in (e) of FIG. 8, a correction voltage having a polarity opposite to a polarity of the detected distortion is applied to the scanning electrodes Y1 through Y5.

In this case, a correction voltage H is added to the voltage waveform on the scanning electrode Y1 as shown in (e) of FIG. 8. In addition, a voltage waveform at the pixel at the intersection of the signal electrode X4 and the scanning electrode Y1 is also corrected as shown in (f) of FIG. 8, whereby an effective voltage applied to the pixel is kept constant. Similarly, voltage waveforms at the remaining pixels on the signal electrode X4 are also corrected, whereby effective voltages applied to the pixels are kept constant.

In addition, a voltage waveform at the pixel at the intersection between the signal electrode X5 and the scanning electrode Y1 is corrected as shown in (g) of FIG. 8, and voltage waveforms at the remaining pixels on the signal electrode X5 are also corrected. Therefore, effective voltages applied to the pixels are kept constant.

As a result, divergence in luminance of each pixel on the signal electrode X4 as well as in luminance of each pixel on the signal electrode X5 is suppressed. Therefore, appearance of vertical stripe lines on the display screen can be prevented.

The above-described conventional method for eliminating crosstalk is effective for such a liquid crystal panel as shown in FIG. 5. However, this method is not effective enough in the case where a single liquid crystal panel is divided into a plurality of display portions and signal electrodes and scanning electrodes are driven on a display portion by display portion basis.

More specifically, a liquid crystal panel is divided into a first display portion 101 and a second display portion 102 as shown in FIG. 9, for example. The first display portion 101 includes signal electrodes X1 through X10 and scanning electrodes Y1 through Y5 located perpendicular to each other for 10×5 dot display. Similarly, the second display portion 102 includes signal electrodes x1 through x10 and scanning electrodes y1 through y5 located perpendicular to each other for 10×5 dot display. The signal electrodes and the scanning electrodes in the first and second display portions 101 and 102 are driven on a display portion by display portion basis.

A detection electrode is not provided in the first display portion 101. A detection electrode is provided only in the second display portion 102. In such a liquid crystal panel, distortion generated at the detection electrode is detected as distortion in a voltage waveform which is induced on any of the scanning electrodes y1 through y5 by the signal electrodes x1 through x10 in the second display portion 102. Then, a correction voltage having a polarity opposite to a polarity of the detected distortion is applied to all of the scanning electrodes y1 through y5. At this time, the same correction voltage is also applied to all of the scanning electrodes Y1 through Y5 in the first display portion 101.

As can be seen from FIG. 9, display states of the first and second display portions 101 and 102 are opposite to each other. More specifically, ON and OFF states of the pixels in the first display portion 101 are opposite to those of the second display portion 102. In this case, signals for driving the first display portion 101 are as shown in (a) through (e) of FIG. 10.

Although signals for the second display portion 102 are not shown in FIG. 10, distortion in a voltage waveform which is induced on any of the scanning electrodes y1 through y5 in the second display portion 102 is eliminated according to the above-mentioned conventional method for eliminating crosstalk. In other words, distortion generated at the detection electrode is detected as distortion in a voltage waveform which is induced on any of the scanning electrodes y1 through y5. Then, a correction voltage having a polarity opposite to a polarity of the detected distortion is applied to all of the scanning electrodes y1 through y5. Thus, the distortion in the voltage waveforms on the scanning electrodes y1 through y5 can be eliminated.

Since the display states of the first and second display portions 101 and 102 are opposite to each other, distortion in a voltage waveform which is induced by the signal electrodes x1 through x10 in the second display portion 102 will be opposite in polarity to that in a voltage waveform which is induced by the signal electrodes X1 through X10 in the first display portion 101. Accordingly, a correction voltage on correcting a voltage waveform on each of the scanning electrodes y1 through y5 in the second display portion 102 will be opposite in polarity to a voltage which can correct a voltage waveform on each of the scanning electrodes Y1 through Y5 in the first display portion 101.

Accordingly, in the case where a correction voltage h for correcting a voltage waveform on a scanning electrode in the second display portion 102 is added to a voltage waveform on the scanning electrode Y1 in the first display portion 101 as shown in (i) of FIG. 10, a voltage waveform at the pixel at the intersection of the signal electrode X4 and the scanning electrode Y1 as shown in (j) of FIG. 10 changes according to the correction voltage h. However, the effective voltage applied to that pixel is reduced. Similarly, effective voltages applied to the remaining pixels on the signal electrode X4 are also reduced. In addition, a voltage waveform at the pixel at the intersection of the signal electrode X5 and the scanning electrode Y1 as shown in (k) of FIG. 10 also changes according to the correction voltage h. However, the effective voltage applied to the pixel is increased. Similarly, effective voltages applied to the remaining pixels on the signal electrode X5 are also increased.

As a result, vertical stripe lines are prevented from being produced on the display screen in the second display portion 102, while being highly emphasized on the display screen in the first display portion 101.

Alternatively, distortion in a voltage waveform which is induced on any of the scanning electrodes Y1 through Y5 by the signal electrodes X1 through X10 in the first display portion 101 and distortion in a voltage waveform which is induced on any of the scanning electrodes y1 through y5 by the signal electrodes x1 through x10 in the second display portion 102 may be detected individually. In this case, a correction voltage having a polarity opposite to a polarity of the detected distortion is formed separately for each of the first and second display portions 101 and 102. Then, the correction voltages are averaged. The resultant average correction voltage is applied to all of the scanning electrodes in the first and second display portions 101 and 102.

In this case, however, a correction voltage formed for the distortion detected in the first display portion 101 is opposite in polarity to that formed for the distortion detected in the second display portion 102. Therefore, these correction voltages are offset, and an average voltage of the correction voltages will be zero. Accordingly, the voltage waveform on the scanning electrode Y1 in the first display portion 101 will not change before and after the average voltage is added thereto, as shown in (i) and (e) of FIG. 11. As a result, a voltage waveform at the pixel at the intersection of the signal electrode X4 and the scanning electrode Y1 as shown in (j) of FIG. 11 and a voltage waveform at the pixel at the intersection of the signal electrode X5 and the scanning electrode Y1 as shown in (k) of FIG. 11 will not change. Consequently, vertical stripe lines on the display screen will not be eliminated.

SUMMARY OF THE INVENTION

According to one aspect of the present invention, a method for driving a liquid crystal display device including a liquid crystal panel which has a pair of substrates facing each other with a liquid crystal layer interposed therebetween and respectively having signal electrodes and scanning electrodes which are located perpendicular to each other, wherein the liquid crystal panel is divided into a plurality of display portions is provided. In the method, the signal electrodes and the scanning electrodes are driven on a display portion by display portion basis, thereby achieving display on the display portions individually. The method includes the step of detecting and correcting distortion of a signal on each of the signal electrodes or each of the scanning electrodes on a display portion by display portion basis.

In one embodiment, a detection electrode is provided in each of the display portions to extend along the scanning electrodes, the method further including the step of detecting distortion of a signal on each detection electrode on a display portion by display portion basis, and forming a correction signal having a polarity opposite to a polarity of the detected distortion so as to apply the correction signal to each of the scanning electrodes of a corresponding one of the display portions, on a display portion by display portion basis.

In one embodiment, a detection electrode is provided in each of the display portions to extend along the scanning electrodes, the method further including the step of detecting distortion of a signal on each detection electrode on a display portion by display portion basis, and forming a correction signal having a polarity identical to a polarity of the detected distortion so as to apply the correction signal to each of the signal electrodes in a corresponding one of the display portions, on a display portion by display portion basis.

In one embodiment, the liquid crystal display device is driven by a voltage averaging method.

In one embodiment, each of the scanning electrodes and each of the signal electrodes are driven by an alternating driving method.

According to another aspect of the present invention, a liquid crystal display device includes a liquid crystal panel which has a pair of substrates facing each other with a liquid crystal layer interposed therebetween and respectively having signal electrodes and scanning electrodes, wherein the signal electrode and the scanning electrode are located perpendicular to each other, the liquid crystal panel is divided into a plurality of display portions. The signal electrodes and the scanning electrodes are driven on a display portion by display portion basis, thereby achieving display on the display portions individually. The liquid crystal display panel further includes a distortion detecting section for detecting distortion of a signal on each of the signal electrodes or each of the scanning electrodes on a display portion by display portion basis and a correction section for correcting the distortion detected by the distortion detecting section on a display portion by display portion basis.

In one embodiment, the distortion detecting section (a) includes a detection electrode provided in each of the display portions to extend along the scanning electrodes, and (b) detects a signal generated at each of the detection electrodes as distortion of a signal at the scanning electrodes of a corresponding one of the display portions. The correction section forms a correction signal having a polarity opposite to a polarity of the detected signal and applies the correction signal to each of the scanning electrodes of the corresponding display portion.

In one embodiment, the distortion detecting section (a) includes a detection electrode provided in each of the display portions to extend along the scanning electrodes, and (b) detects a signal generated at each of the detection electrodes as distortion of a signal at the scanning electrodes of a corresponding one of the display portions. The correction section forms a correction signal having a polarity identical to a polarity of the detected signal and applies the correction signal to each of the signal electrodes of the corresponding display portion.

According to the structure of the present invention, distortion of a signal on each of the scanning electrodes and each of the signal electrodes is detected and corrected on a display portion by display portion basis. Accordingly, distortion is detected and corrected according to a display pattern of each display portion. Therefore, distortion correction in one display portion can be conducted without any influence on the other display portion(s). As a result, distortion correction can be ensured.

Thus, the invention described herein makes possible the advantages of (1) providing a liquid crystal display device including a liquid crystal panel divided into a plurality of display portions; and (2) providing a method for driving the same capable of sufficiently suppressing crosstalk even when the display on the plurality of display portions is realized on a display portion by display portion basis.

These and other advantages of the present invention will become apparent to those skilled in the art upon reading and understanding the following detailed description with reference to the accompanying figures.

DESCRIPTION OF THE PREFERRED EMBODIMENTS

Examples of the present invention will now be described with reference to the accompanying drawings.

Figure 1A:
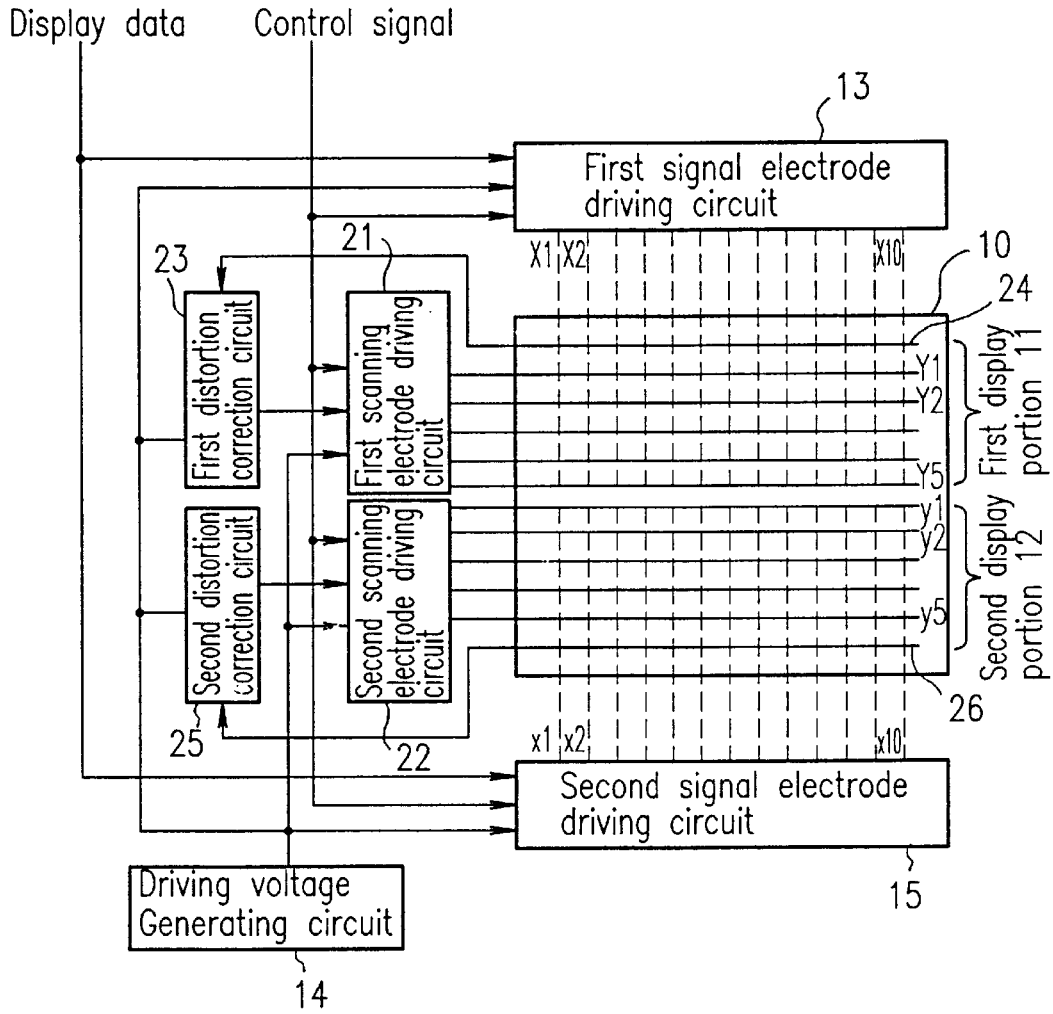
FIG. 1A is a block diagram schematically showing a liquid crystal display device to which a driving method according one example of the present invention is applied.

FIG. 1A schematically shows a liquid crystal display device to which a driving method according to one example of the present invention is applied. The liquid crystal display device according to the present invention is driven by a general voltage averaging method and an alternating driving method.

Referring to FIG. 1A, a liquid crystal panel 10 includes a pair of transparent substrates facing each other with a liquid crystal layer interposed therebetween. Signal electrodes are arranged parallel to each other on one of the pair of transparent substrates, whereas scanning electrodes are arranged parallel to each other on the other transparent substrate. The pair of transparent substrates are located facing each other such that the signal electrodes and the scanning electrodes are located perpendicular to each other.

The liquid crystal panel 10 is divided into a first display portion 11 and a second display portion 12. Signal electrodes X1 through X10 and scanning electrodes Y1 through Y5 are assigned to the first display portion 11 for 10×5 dot display. Similarly, signal electrodes x1 through x10 and scanning electrodes y1 through y5 are assigned to the second display portion 12 for 10×5 dot display. A pixel is formed at each intersection of the signal electrodes and the scanning electrodes.

Figure 9:
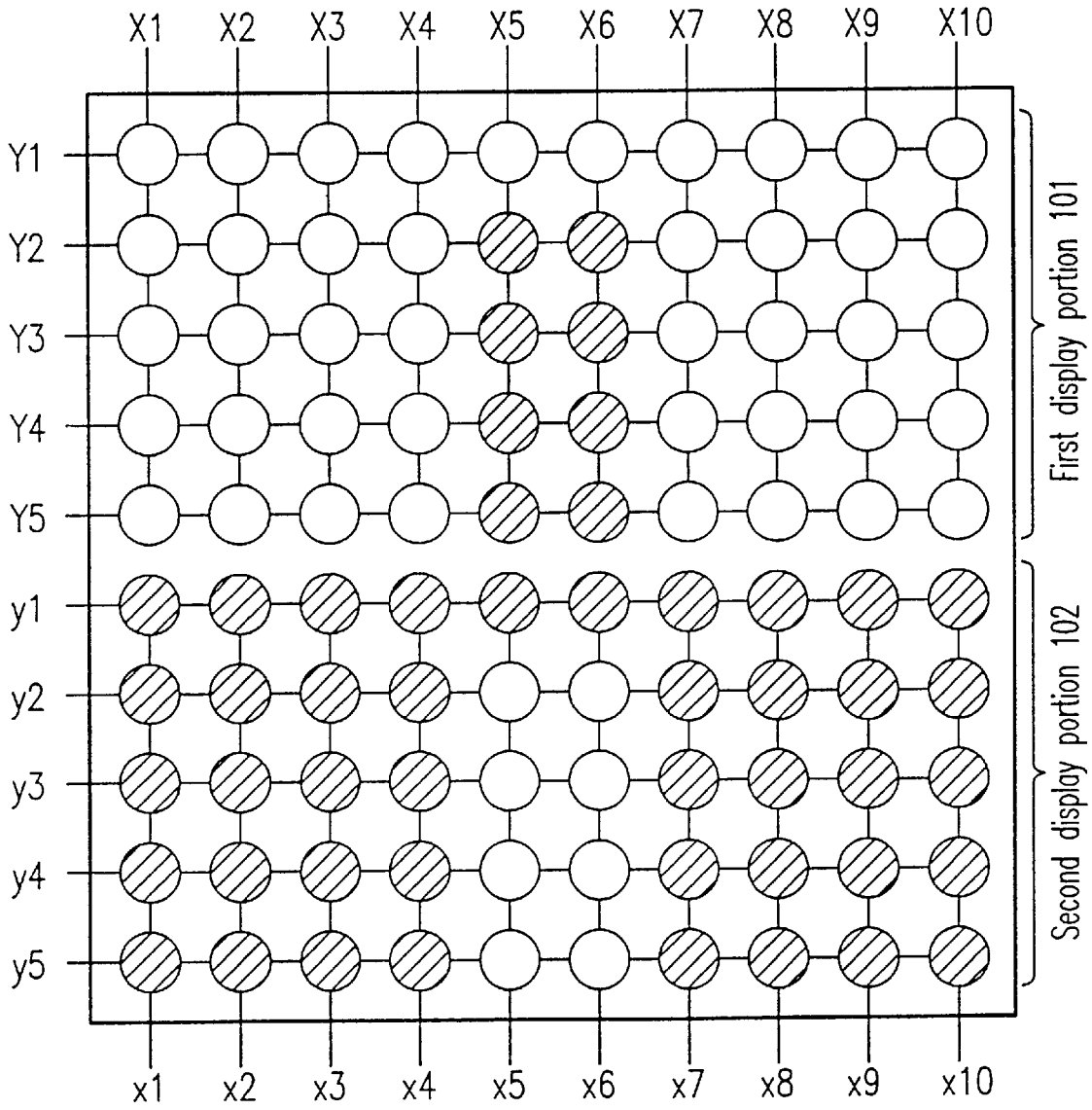
FIG. 9 is a plan view schematically showing another example of the liquid crystal panel.
Figure 10:
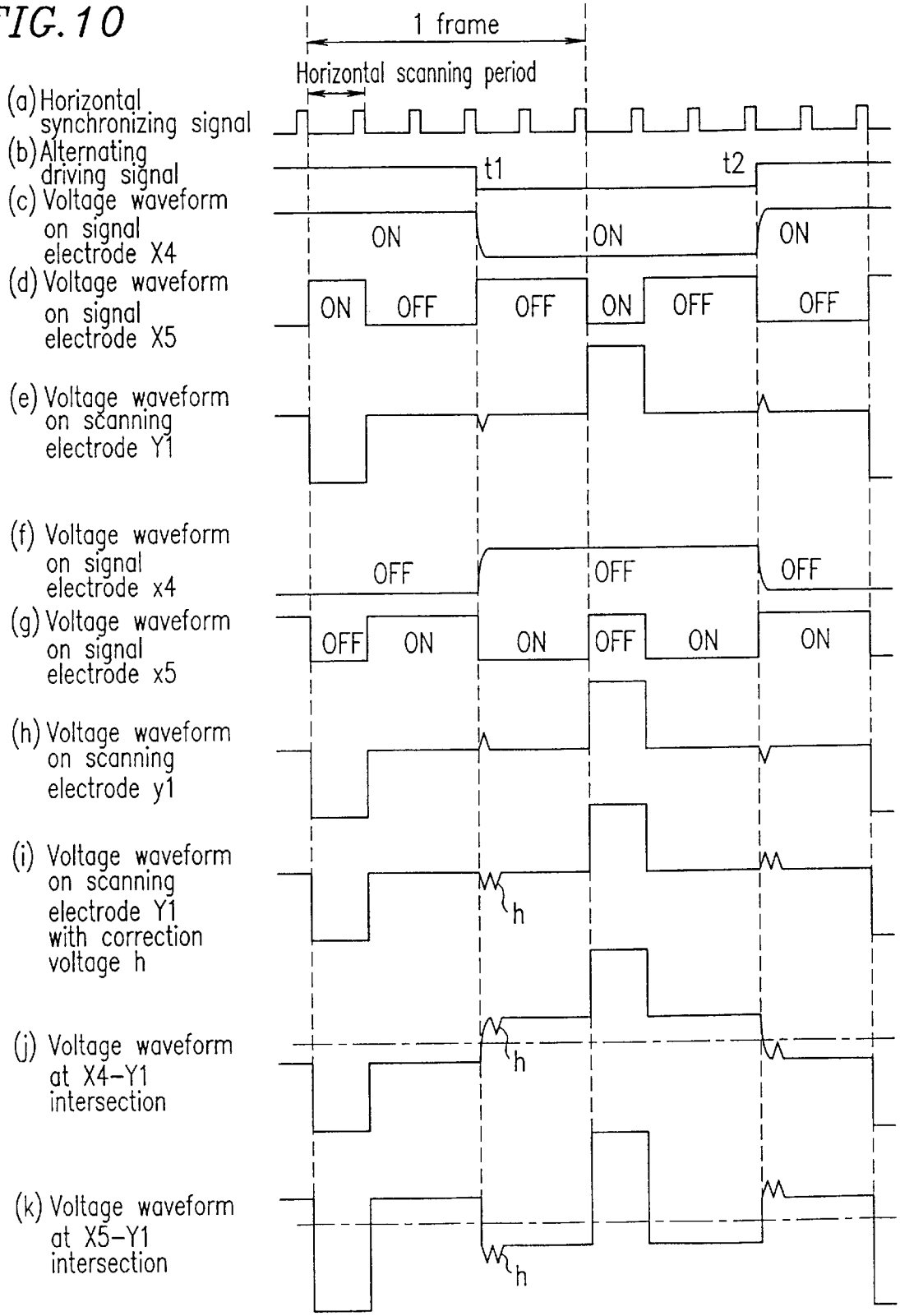
FIG. 10 is a timing chart showing signals for driving the liquid crystal panel of FIG. 9 based on a conventional driving method.
Figure 11:
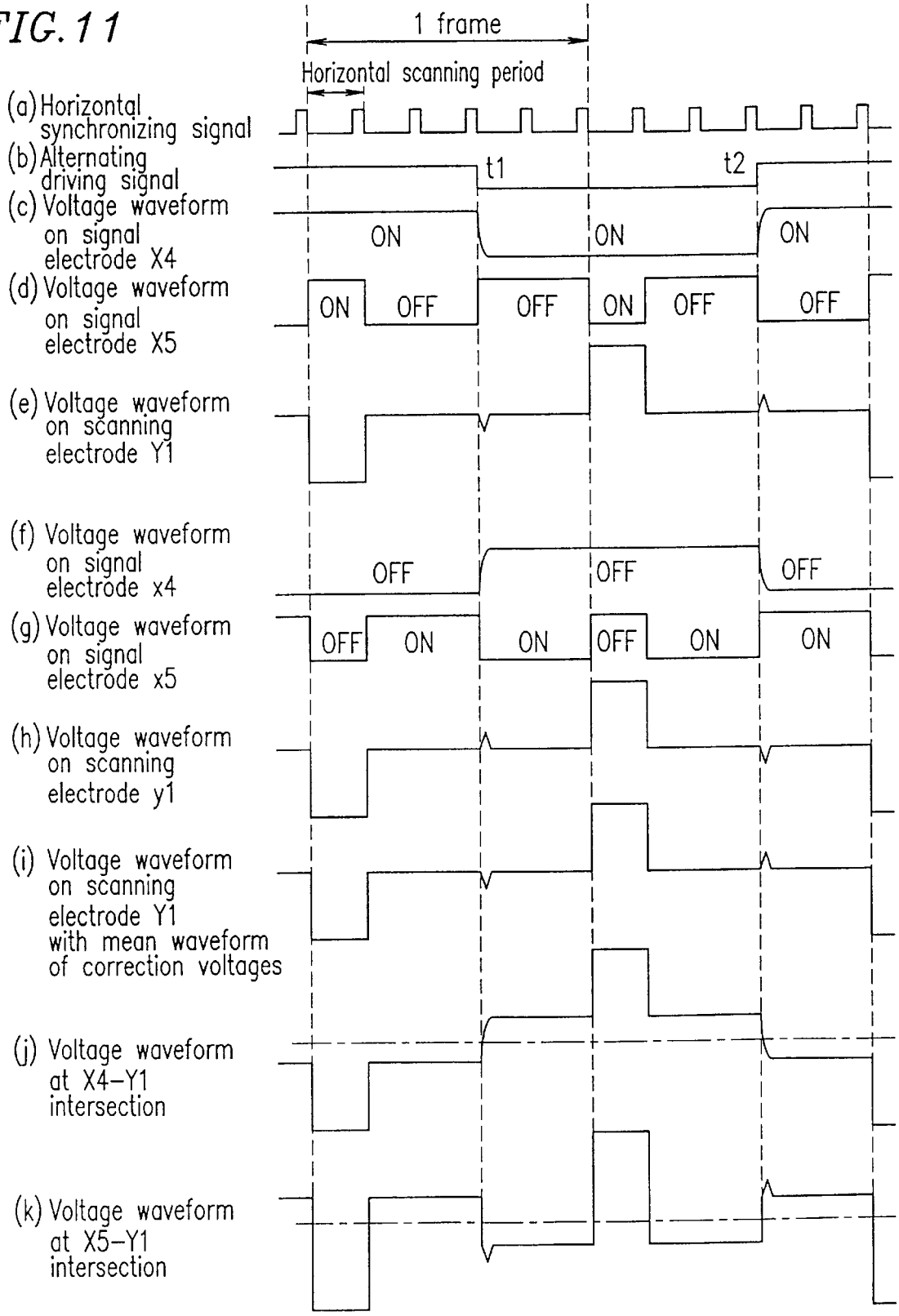
FIG. 11 is another timing chart showing signals for driving the liquid crystal panel of FIG. 9 based on a conventional driving method.

Display states of the first and second display portions 11 and 12 are opposite to each other, as in the case of the first and second display portions 101 and 102 shown in FIG. 9. More specifically, ON and OFF states of the pixels in the first display portion 11 are opposite to those of the pixels in the second display portion 12.

A first signal electrode driving circuit 13 receives display data and a control signal, and also receives a plurality of voltages for driving the signal electrodes from a driving voltage generating circuit 14. The first signal electrode driving circuit 13 then forms voltage waveforms for driving the signal electrodes, based on the display data and the control signal, and applies the voltage waveforms to the signal electrodes X1 through X10 of the first display portion 11 so as to drive the signal electrodes X1 through X10. For example, the first signal electrode driving circuit 13 applies a voltage waveform as shown in (c) of FIG. 2 to the signal electrode X4, and a voltage waveform as shown in (d) of FIG. 2 to the signal electrode X5.

Similarly, a second signal electrode driving circuit 15 receives display data and a control signal, and also receives a plurality of voltages for driving the signal electrodes from the driving voltage generating circuit 14. The second signal electrode driving circuit 15 then forms voltage waveforms for driving the signal electrodes, based on the display data and the control signal, and applies the voltage waveforms to the driving electrodes x1 through x10 of the second display portion 12 so as to drive the signal electrodes x1 through x10. For example, the second signal electrode driving circuit 15 applies a voltage waveform as shown in (c) of FIG. 3 to the signal electrode x4, and a voltage waveform as shown in (d) of FIG. 3 to the signal electrode x5.

A first scanning electrode driving circuit 21 receives a control signal, and also receives a plurality of voltages for driving the scanning electrodes from the driving voltage generating circuit 14. The first scanning electrode driving circuit 21 then applies voltage waveforms to the scanning electrodes Y1 through Y5 of the first display portion 11 in response to the control signal so as to drive the scanning electrodes Y1 through Y5. For example, the first scanning electrode driving circuit 21 applies a voltage waveform as shown in (e) of FIG. 2 to the scanning electrode Y1.

Similarly, a second scanning electrode driving circuit 22 receives a control signal, and also receives a plurality of voltages for driving the scanning electrodes from the driving voltage generating circuit 14. The second scanning electrode driving circuit 21 then applies voltage waveforms to the scanning electrodes y1 through y5 of the second display portion 12 in response to the control signal so as to drive the scanning electrodes y1 through y5. For example, the second scanning electrode driving circuit 22 applies a voltage waveform as shown in (e) of FIG. 3 to the scanning electrode y1.

Each voltage waveform applied from the first and second signal electrode driving circuits 13 and 15 as well as from the first and second scanning electrode driving circuits 21 and 22 to a corresponding electrode is produced based on a voltage averaging method. Moreover, the polarity of each voltage waveform is inverted in response to an alternating driving signal as shown in (b) of FIG. 2 and (b) of FIG. 3.

A first distortion correction circuit 23 has a first detection electrode 24 extending along the scanning electrodes Y1 through Y5 of the first display portion 11. The first distortion correction circuit 23 detects distortion generated at the detection electrode 24 as distortion in a voltage waveform which is induced on any of the scanning electrodes Y1 through Y5. Then, the first distortion correction circuit 23 inverts and amplifies the detected distortion by an operational amplifier to form a correction voltage having a polarity opposite to a polarity of the detected distortion. The first distortion correction circuit 23 applies the correction voltage through the first scanning electrode driving circuit 21 to all of the scanning electrodes Y1 through Y5.

Figure 2:
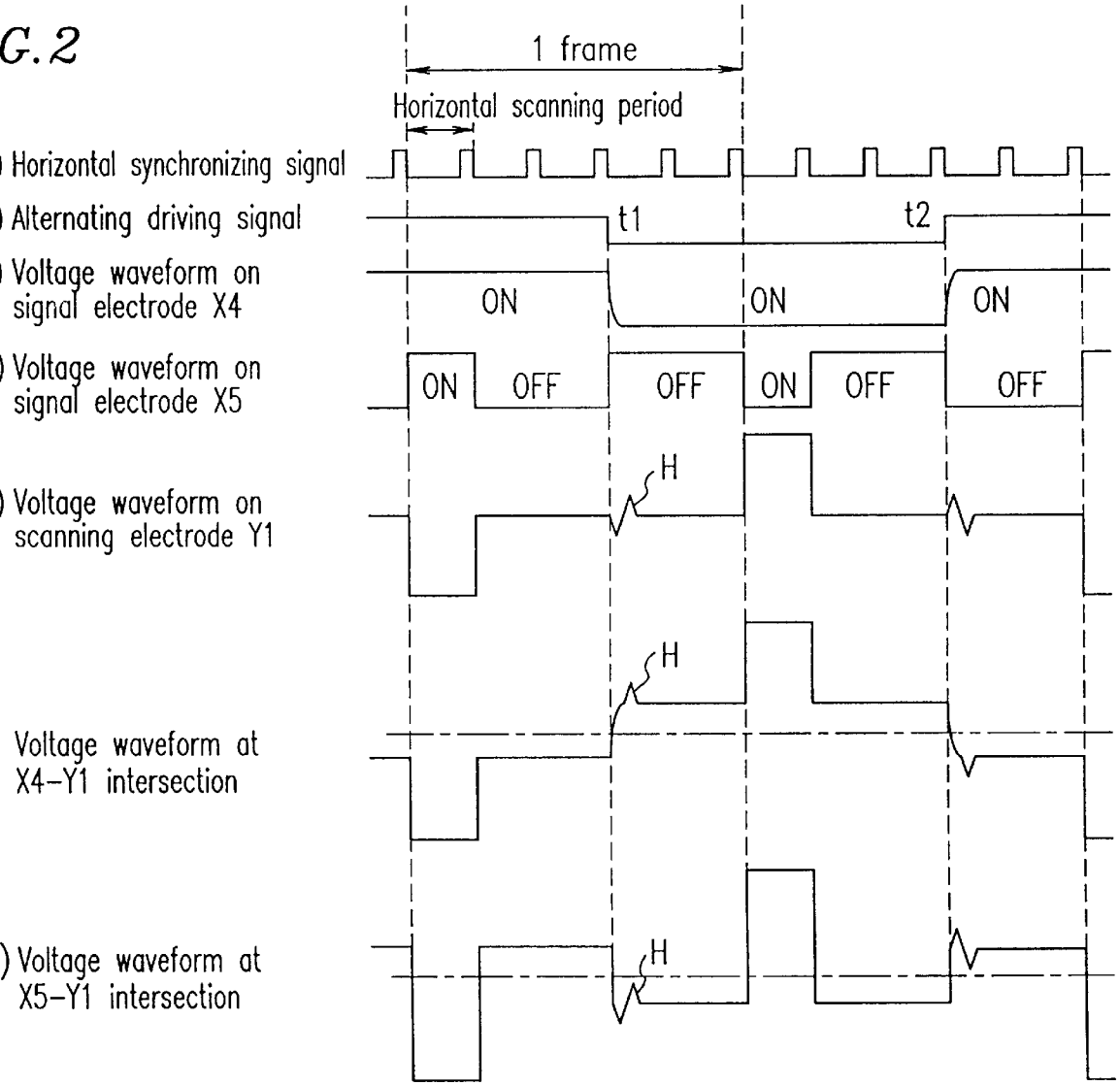
FIG. 2 is a timing chart showing signals for driving a first display portion of a liquid crystal panel of the liquid crystal display device of FIG. 1A.

For example, a correction voltage H as shown in (e) of FIG. 2 is added to the voltage waveform on the scanning electrode Y1. Accordingly, the voltage waveform at the pixel at the intersection of the signal electrode X4 and the scanning electrode Y1 as shown in (f) of FIG. 2 is corrected. As a result, an effective voltage applied to that pixel is kept constant. Similarly, respective voltage waveforms at the other pixels on the signal electrode X4 are also corrected. Accordingly, respective effective voltages applied to these pixels are kept constant.

In addition, a voltage waveform of the pixel at the intersection of the signal electrode X5 and the scanning electrode Y1 as shown in (g) of FIG. 2 is corrected. As a result, an effective voltage applied to the pixel is kept constant. Similarly, respective voltage waveforms of the other pixels on the signal electrode X5 are also corrected. Accordingly, respective effective voltages applied to these pixels are kept constant.

Consequently, divergence in luminance of each pixel on the signal electrode X4 and the scanning electrode Y5 is suppressed in the first display portion 11. Therefore, appearance of vertical stripe lines on the display screen in the first display portion 11 can be prevented.

A second distortion correction circuit 25 has a second detection electrode 26 extending along the scanning electrodes y1 through y5 of the second display portion 12. The second distortion correction circuit 25 detects distortion generated a t the second detection electrode 26 as distortion in a voltage waveform which is induced on any of the scanning electrodes y1 through y5. Then, the second distortion correction circuit 25 inverts and amplifies the detected distortion by an operational amplifier to form a correction voltage having a polarity opposite to a polarity of the detected distortion. The second distortion correction circuit 25 applies the correction voltage through the second scanning electrode driving circuit 22 to all of the scanning electrodes yl through y5.

Figure 3:
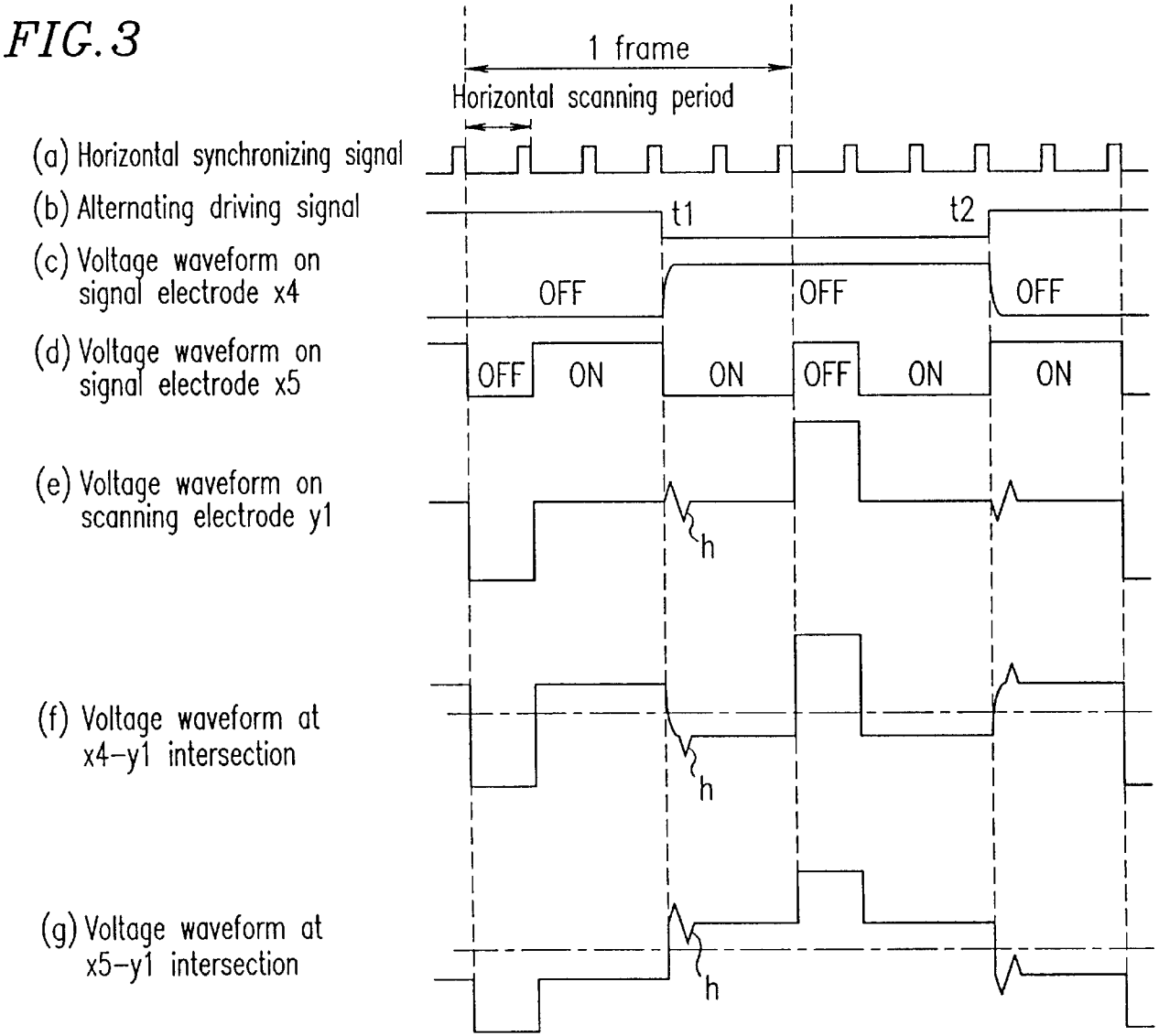
FIG. 3 is a timing chart showing signals for driving a second display portion of the liquid crystal panel in the liquid crystal display device of FIG. 1A.

For example, a correction voltage h is added to the voltage waveform on the scanning electrode y1, as shown in (e) of FIG. 3. Accordingly, a voltage waveform of the pixel at the intersection of the signal electrode x4 and the scanning electrode y1 as shown in (f) of FIG. 3 is corrected. As a result, an effective voltage applied to that pixel is kept constant. Similarly, respective voltage waveforms of the other pixels on the signal electrode x4 are also corrected. Accordingly, respective effective voltages applied to these pixels are kept constant.

In addition, a voltage waveform of the pixel at the intersection of the signal electrode x5 and the scanning electrode y1 as shown in (g) of FIG. 3 is corrected. Accordingly, an effective voltage applied to that pixel is kept constant. Similarly, respective voltage waveforms at the other pixels on the signal electrode x5 are also corrected. As a result, respective effective voltages applied to these pixels are kept constant.

Consequently, divergence in luminance of each pixel on the signal electrode x4 and the scanning electrode y5 is also suppressed in the second display portion 12. Therefore, appearance of vertical stripe lines on the display screen of the second display portion 12 can be prevented.

As described above, distortion of a voltage waveform on each scanning electrode in the first and second display portions 11 and 12 is detected and corrected on a display portion by display portion basis, whereby correction of the distortion is ensured regardless of a display pattern of the first and second display portions 11 and 12. As a result, vertical stripe lines can be prevented from being produced on the display screen of both the first and second display portions 11 and 12.

Figure 1B:
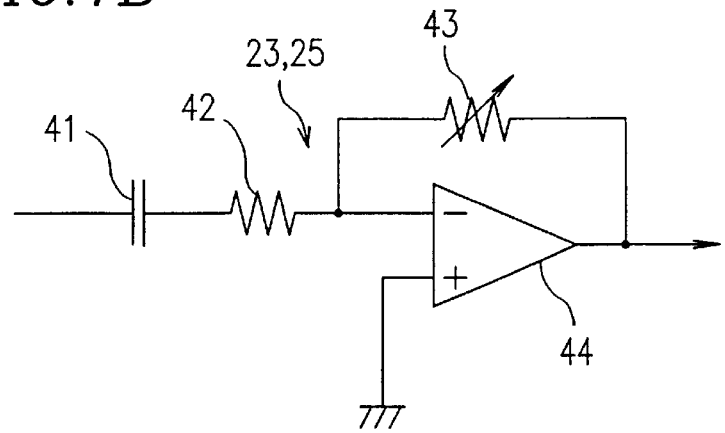
FIG. 1B is a circuit diagram showing a structure of first and second distortion correction circuits of FIG. 1A.

FIG. 1B shows the structure of each of the first and second distortion correction circuits 23 and 25. In FIG. 1B, a signal detected by the detection electrode 24 (or 26) is applied to a capacitor 41. Only a distortion component of the signal passes through the capacitor 41, and the distortion is added through a resistance 42 to an operational amplifier 44. The operational amplifier 44 inverts and amplifies the distortion to form a correction voltage for output.

Figure 4:
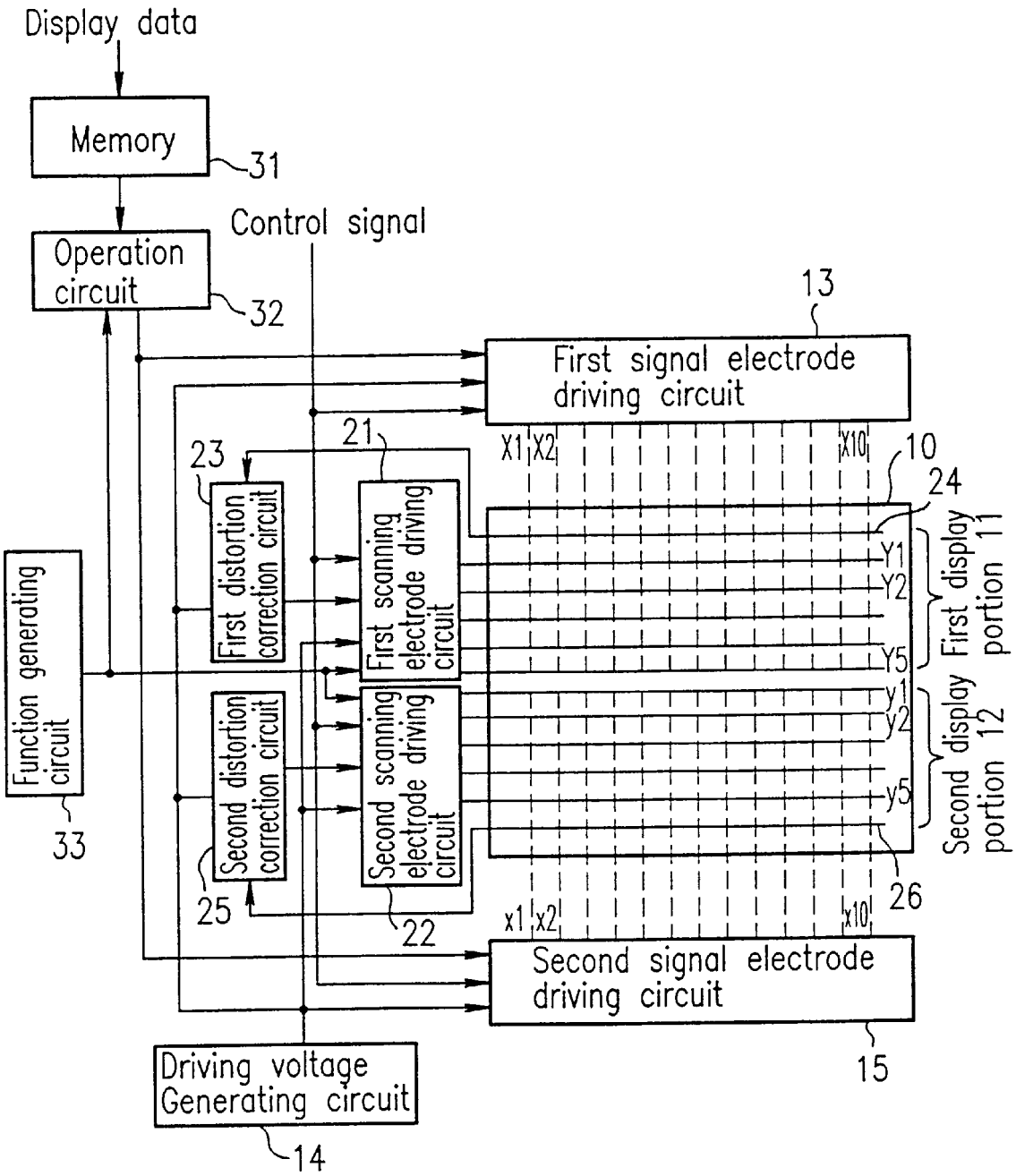
FIG. 4 is a block diagram schematically showing another example of the liquid crystal display device to which a driving method according one example of the present invention is applied.
Figure 5:
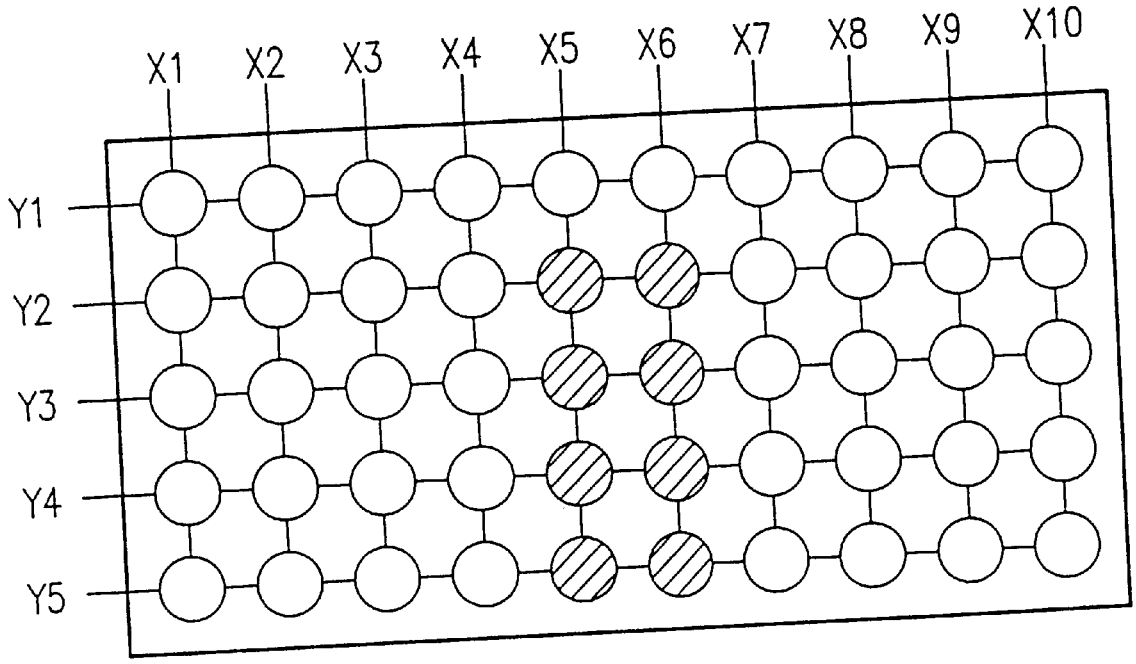
FIG. 5 is a plan view schematically showing a liquid crystal panel.
Figure 6:
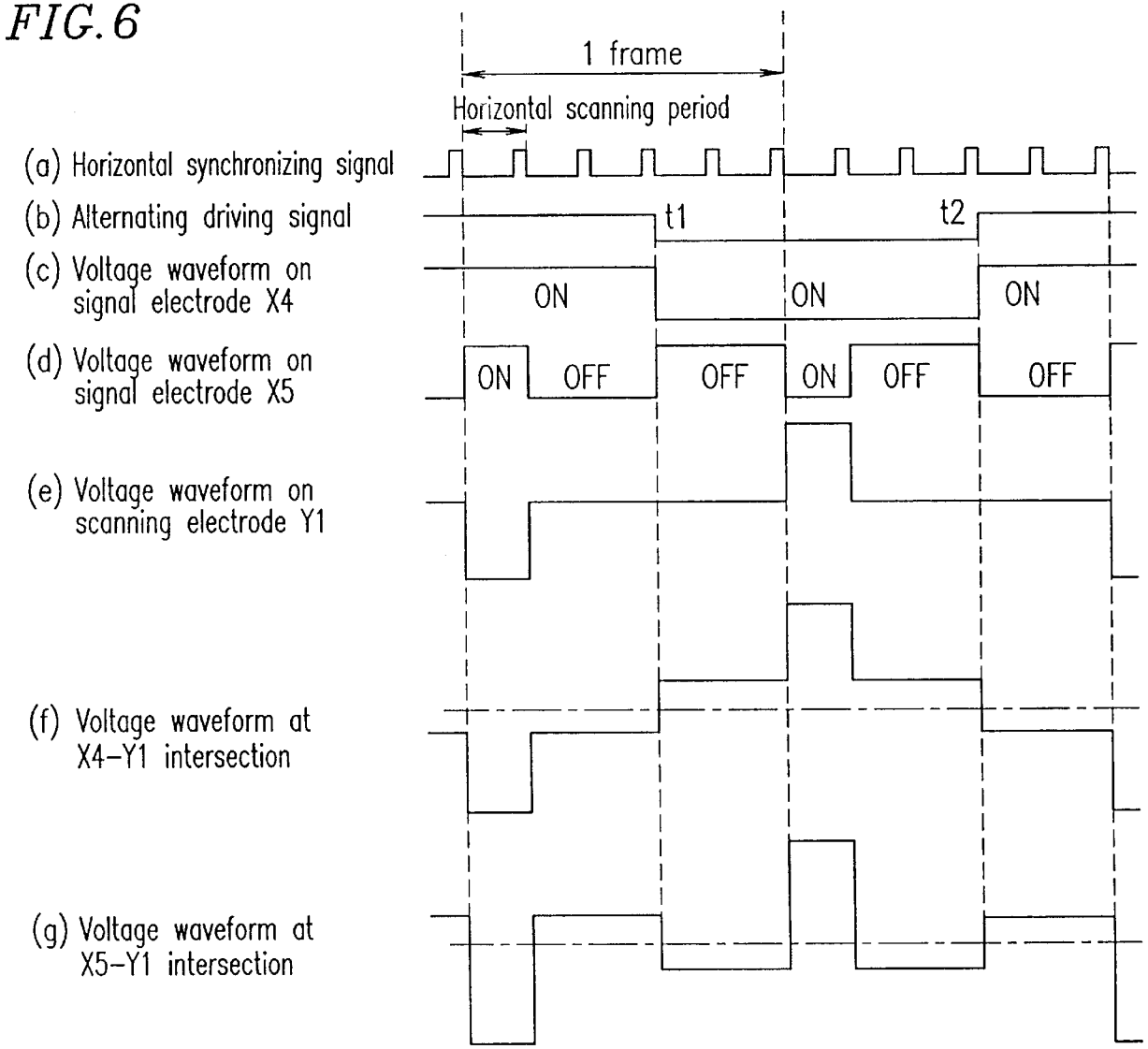
FIG. 6 is a timing chart showing signals ideal for driving the liquid crystal panel of FIG. 5.
Figure 7:
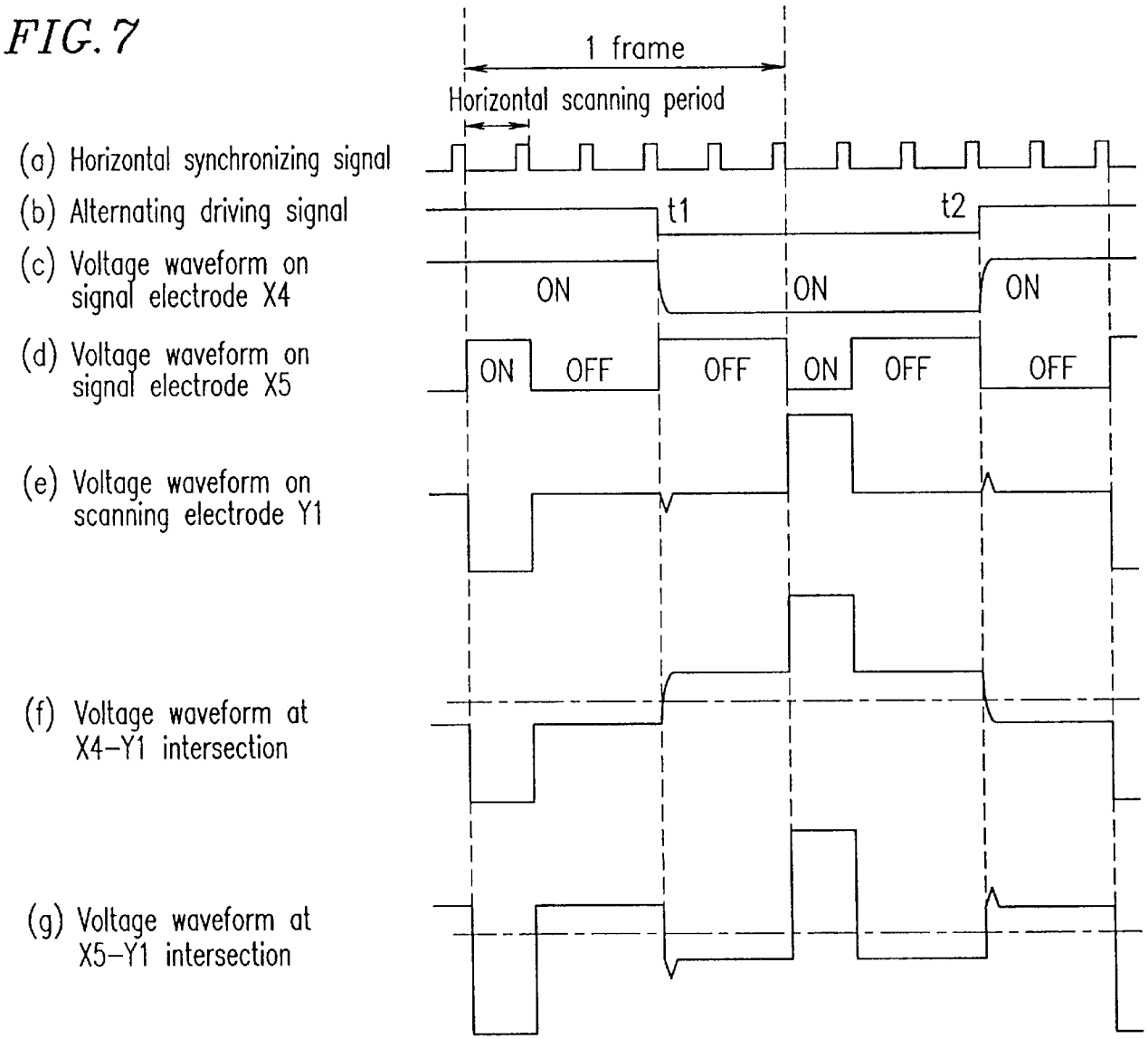
FIG. 7 is a timing chart showing conventional signals for driving the liquid crystal panel of FIG. 5.
Figure 8:
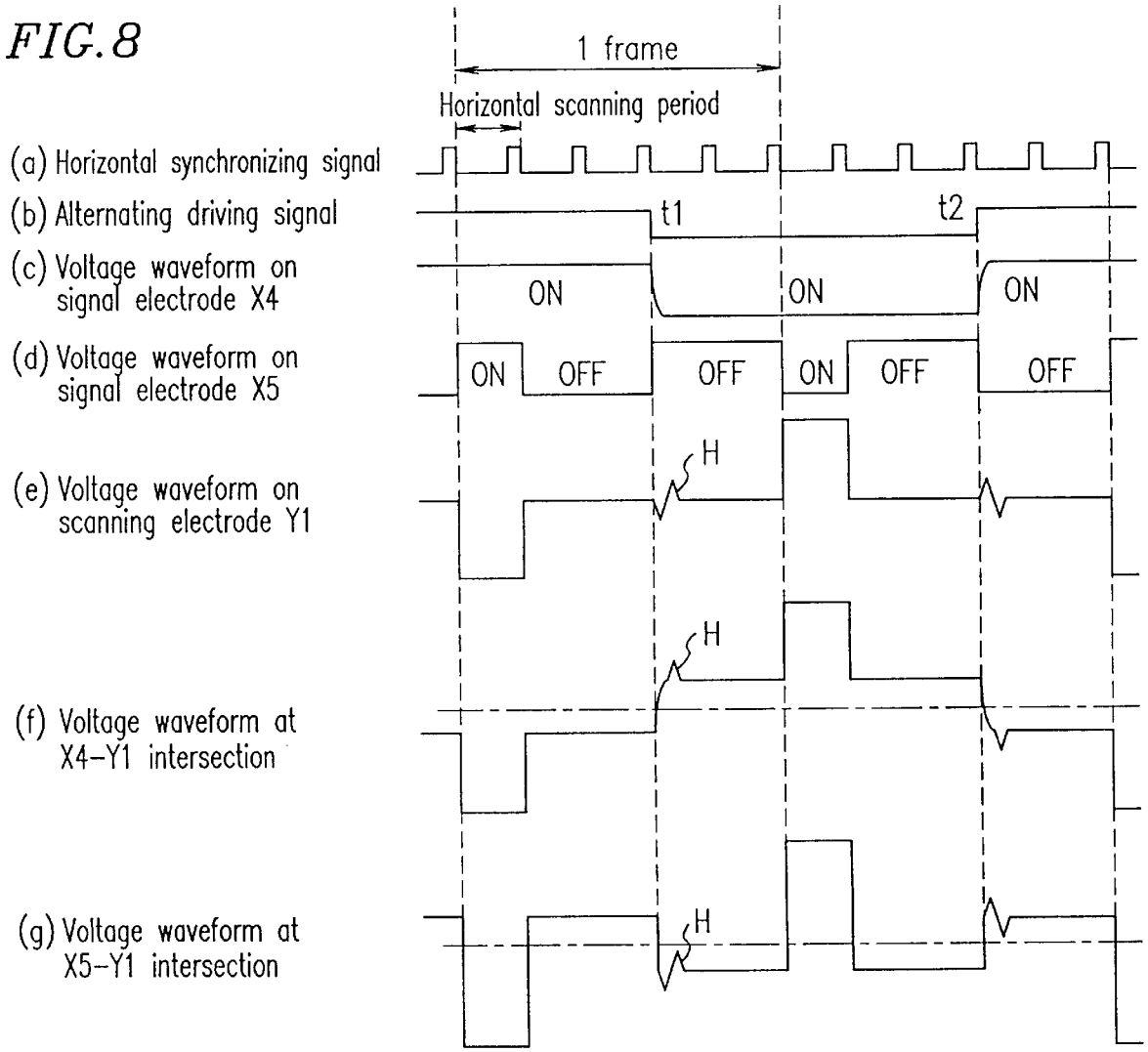
FIG. 8 is a timing chart showing signals for driving the liquid crystal panel of FIG. 5 based on a conventional driving method.

FIG. 4 schematically shows another example of the liquid crystal display device to which a driving method according to one example of the present invention is applied. This liquid crystal display device is driven according to a method for simultaneously selecting and driving a plurality of rows and an alternating driving method.

It should be noted that like elements are denoted with the like reference numerals and characters in FIGS. 1A, 1B and 4, for convenience.

This liquid crystal display device first stores display data in a memory 31. An operation circuit 32 performs orthogonal transformation of display data stored in the memory 31 based on an orthogonal matrix produced by a function generating circuit 33. Then, the resultant display data is applied to first and second signal electrode driving circuits 13 and 15.

The first and second signal electrode driving circuits 13 and 15 receive the orthogonally transformed display data and a control signal, and also receive a voltage waveform for driving a signal electrode from a driving voltage generating circuit 14. Then, the first and second signal electrode driving circuits 13 and 15 respectively apply a voltage waveform for driving a signal electrode which corresponds to the received display data to signal electrodes X1 through X10 in a first display portion 11 and signal electrodes x1 through x10 in a second display portion 12 so as to drive the signal electrodes.

A first scanning electrode driving circuit 21 receives a control signal and an orthogonal matrix which is generated by the function generating circuit 33, and also receives a voltage waveform for driving a scanning electrode from the driving voltage generating circuit 14. Then, the first scanning electrode driving circuit 21 applies a voltage waveform for driving a scanning electrode which corresponds to the received orthogonal matrix to scanning electrodes Y1 through Y5 in a first display portion 11 so as to drive the scanning electrodes Y1 through Y5.

Accordingly, in the first display portion 11, a voltage waveform corresponding to the difference between the voltage waveform for driving a signal electrode which corresponds to the orthogonally transformed display data and the voltage waveform for driving a scanning electrode which corresponds to the orthogonal matrix produced by the function generating circuit 33 is applied to each intersection of the signal electrodes X1 through X10 and the scanning electrodes Y1 through Y5. Then, inverse transformation of the display data is performed in the first display portion 11, whereby an image is displayed.

Similarly, a second scanning electrode driving circuit 22 receives a control signal and an orthogonal matrix which is generated by the function generating circuit 33, and also receives a voltage waveform for driving a scanning electrode from the driving voltage generating circuit 14. Then, the second scanning electrode driving circuit 22 applies a voltage waveform for driving a scanning electrode which corresponds to the received orthogonal matrix to scanning electrodes yl through y5 in a second display portion 12 so as to drive the scanning electrodes y1 through y5. Accordingly, in the second display portion 12, a voltage waveform corresponding to the difference between the voltage waveform for driving a signal electrode which corresponds to the orthogonally transformed display data and the voltage waveform for driving a scanning electrode which corresponds to the orthogonal matrix produced by the function generating circuit 33 is applied to each intersection of the signal electrodes x1 through x10 and the scanning electrodes y1 through y5. Then, inverse transformation of the display data is performed in the second display portion 12, whereby an image is displayed.

As can be seen from the above description, in the method for simultaneously selecting and driving a plurality of rows, a voltage waveform for driving a signal electrode is determined based on an orthogonal matrix and display data. Accordingly, in the case where display data provided to the first display portion 11 is different from that provided to the second display portion 12, distortion induced on the scanning electrodes Y1 through Y5 in the first display portion 11 is different from that induced on the scanning electrodes y1 through y5 in the second display portion 12. Accordingly, respective distortion in the first and second display portions 11 and 12 is separately detected and corrected by the respective first and second distortion correction circuits 23 and 25, as in the case of the liquid crystal display device of FIG. 1A. Thus, distortion correction can be ensured regardless of a display pattern of the first and second display portions 11 and 12. Consequently, appearance of vertical stripe lines on the display screen can be prevented in the first and second display portions 11 and 12.

In the above-described examples, distortion generated at the detection electrode is detected as distortion in a voltage waveform which is induced on a scanning electrode. In short, distortion in a voltage waveform on a scanning electrode is detected indirectly. However, the present invention is not limited to this. Distortion may be detected directly from a scanning electrode. In such a case, for example, the difference between a voltage waveform applied to a scanning electrode and a voltage waveform detected from the scanning electrode may be obtained as distortion. Alternatively, it is also possible to obtain distortion produced at an electrode which results from digital processing of display data, an alternating driving signal, and the like to produce a correction voltage in the form of a digital signal or a correction voltage in the form of an analog signal resulting from digital/analog conversion of the digital signal. Further, a correction voltage corresponding to distortion may be applied to each signal electrode, as recited in claim 3. The present invention can also be applied to a liquid crystal display device having a liquid crystal panel divided into three or more display portions.

As has been described above, according to the present invention, distortion of a signal on a signal electrode or a scanning electrode is detected and corrected on a display portion by display portion basis. Therefore, distortion correction for each display portion can be ensured regardless of a display pattern of the display portions.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a liquid crystal display device including a liquid crystal panel which has a pair of substrates facing each other with a liquid crystal layer interposed therebetween, and said substrates respectively have signal electrodes and scanning electrodes which are located perpendicular to each other, wherein:

the liquid crystal panel is divided into a plurality of display portions each having a display state opposite to those of said plurality of display portions perpendicularly adjacent thereto, a detection electrode is provided in each of the display portions extending along the scanning electrodes, and the signal electrodes and the scanning electrodes are driven on a display portion by display portion basis, thereby achieving display on said display portions individually, the method comprising the steps of:

detecting the distortion of a signal on each of said detection electrodes on a display portion by display portion basis, forming correction signals having a polarity opposite to a polarity of the detected distortions, and applying the correction signals to each of the scanning electrodes of a corresponding one of the display portions on a display portion by display portion basis.

2. A method for driving a liquid crystal display device according to claim 1, wherein the liquid crystal display device is driven by a voltage averaging method.

3. A method for driving a liquid crystal display device according to claim 1, wherein each of the scanning electrodes and each of the signal electrodes are driven by an alternating driving method.

4. A method for driving a liquid crystal display device including a liquid crystal panel which has a pair of substrates facing each other with a liquid crystal layer interposed therebetween, and said substrates respectively have signal electrodes and scanning electrodes which are located perpendicular to each other, wherein the liquid crystal panel is divided into a plurality of display portions each having a display state opposite to those of said plurality of display portions perpendicularly adjacent thereto, a detection electrode is provided in each of the display portions extending along the scanning electrodes, and the signal electrodes and the scanning electrodes are driven on a display portion by display portion basis, thereby achieving display on said display portions individually, the method comprising the steps of:

detecting distortion of a signal on each detection electrode on a display portion by display portion basis, forming a correction signals having a polarity identical to a polarity of the detected distortions, and applying the correction signals to each of the signal electrodes in a corresponding one of the display portions, on a display portion by display portion basis.

5. A method for driving a liquid crystal display device according to claim 4, wherein the liquid crystal display device is driven by a voltage averaging method.

6. A method for driving a liquid crystal display device according to claim 4, wherein each of the scanning electrodes and each of the signal electrodes are driven by an alternating driving method.

7. A liquid crystal display device, comprising:

a liquid crystal panel which has a pair of substrates facing each other with a liquid crystal layer interposed therebetween, and said substrates respectively have signal electrodes and scanning electrodes, wherein:

the signal electrodes and the scanning electrodes are located perpendicular to each other, the liquid crystal panel is divided into a plurality of display portions, each said display portion having a display state opposite to those of said plurality of display portions perpendicularly adjacent thereto, and the signal electrodes and the scanning electrodes are driven on a display portion by display portion basis, thereby achieving display on the display portions individually, the liquid crystal display panel further comprising:

a distortion detecting section for detecting a distortion of a signal on each of the scanning electrodes on a display portion by display portion basis; and a correction section for correcting the distortions detected by the distortion detecting section on a display portion by display portion basis;

wherein the distortion detecting section (a) includes a detection electrode provided in each of the display portions extending along the scanning electrodes, and (b) detects a signal generated at each of the detection electrodes as distortion of a signal at the scanning electrodes of a corresponding one of the display potions, and the correction section forms correction signals having a polarities opposite to the polarities of the detected signals and applies the correction signals respectively to each of the scanning electrodes of the corresponding display portion.

8. A liquid crystal display device, comprising:

a liquid crystal panel which has a pair of substrates facing each other with a liquid crystal layer interposed therebetween, and said substrates respectively have signal electrodes and scanning electrodes, wherein:

the signal electrodes and the scanning electrodes are located perpendicular to each other, the liquid crystal panel is divided into a plurality of display portions, each having a display state opposite to those of said plurality of display portions perpendicularly adjacent thereto, and the signal electrodes and the scanning electrodes are driven on a display portion by display portion basis, thereby achieving display on the display portions individually, the liquid crystal display panel further comprising a distortion detecting section for detecting distortion of a signal on each of the scanning electrodes on a display portion by display portion basis; and a correction section for correcting, the distortions detected by the distortion detecting section on a display portion by display portion basis;

wherein the distortion detecting section (a) includes a detection electrode provided in each of the display portions extending along the scanning electrodes, and (b) detects a signal generated at each of the detection electrodes as distortion of a signal at the scanning electrodes of a corresponding one of the display portions, and the correction section forms correction signals having a polarities identical to the polarities of the detected signals and applies the correction signals respectively to each of the signal electrodes of the corresponding display portion.

* * * * *